United States Patent [19]

Sorton

[11] Patent Number: 4,947,616

[45] Date of Patent: Aug. 14, 1990

[54] TOOL FOR USE IN MOUNTING A JOIST HANGER

[76] Inventor: Steven W. Sorton, 1341 Haskell, Berkeley, Calif. 94702

[21] Appl. No.: 355,720

[22] Filed: May 22, 1989

[51] Int. Cl.[5] ..... E04D 15/00

[52] U.S. Cl. ..... 52/749; 52/DIG. 1; 33/613; 33/645

[58] Field of Search ..... 52/DIG. 1, 702, 749; 33/404, 423, 613, 645, DIG. 1, DIG. 16

[56] References Cited

U.S. PATENT DOCUMENTS

| | | | |
|---|---|---|---|
| 456,553 | 7/1891 | Carr . | |
| 723,518 | 3/1903 | Ellison . | |
| 804,067 | 11/1905 | Stowe . | |
| 2,197,278 | 4/1940 | Sverdahl | 33/613 X |
| 2,891,318 | 11/1954 | Harrison et al. | 33/ |
| 2,911,022 | 10/1957 | Brown | 145/ |
| 2,960,953 | 11/1960 | Schneider | 113/ |
| 3,436,070 | 4/1969 | Utley et al. | 33/DIG. 1 |
| 3,673,664 | 7/1972 | Niese | 29/ |
| 4,131,268 | 12/1978 | Valade | 269/ |
| 4,340,100 | 7/1982 | Anderson | 33/613 X |
| 4,514,072 | 4/1985 | Buckley | 354/ |
| 4,753,014 | 6/1988 | Vrajich | 33/613 |

*Primary Examiner*—Carl D. Friedman

*Attorney, Agent, or Firm*—Townsend and Townsend

[57] ABSTRACT

A tool having a first member adapted to rest on the upper face of a header to which a joist hanger is to be mounted. A magnetic structure is coupled with the first member for holding a joist hanger in place by magnetic attraction as the first member is supported on the upper margin of the header. Thus, the hanger can be nailed. The magnetic structure includes a second member coupled with the first member and has a pair of opposed flat side faces provided with magnetic structure thereon. Such magnetic structure can be in the form of spaced, permanent magnets extending into holes drilled in the side faces of the second member. The second member can be removably and adjustably coupled to the first member by alignment structure.

14 Claims, 2 Drawing Sheets

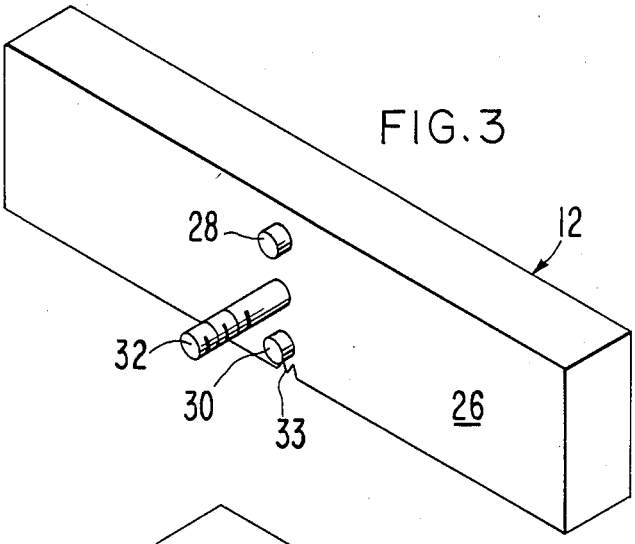
FIG. 3
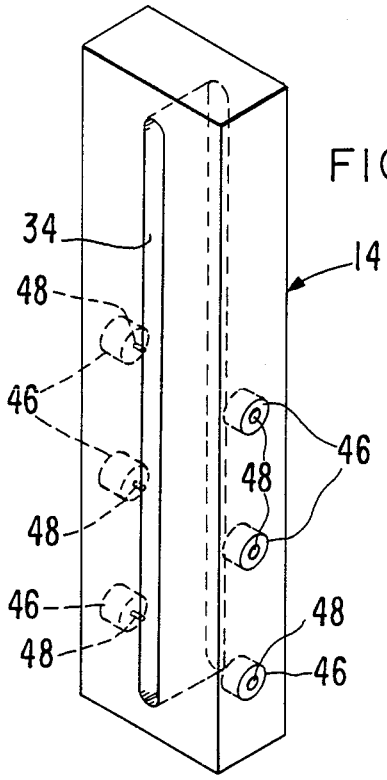
FIG. 4
FIG. 5
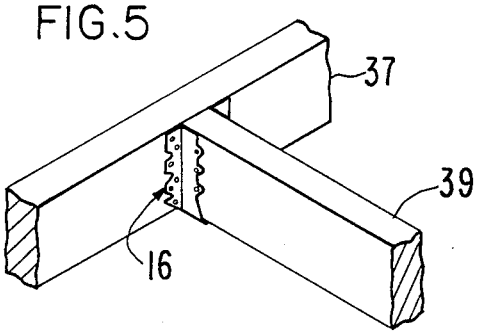
FIG. 6
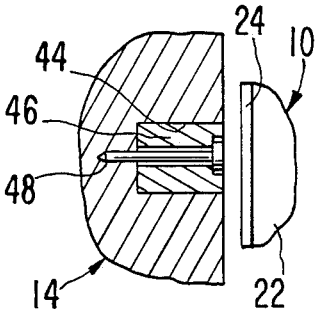

TOOL FOR USE IN MOUNTING A JOIST HANGER

FIELD OF THE INVENTION

This invention relates to improvements in tools used by carpenters and, more particularly, to a tool for use in mounting a joist hanger on a header.

BACKGROUND OF THE INVENTION

In mounting ceiling or floor joists on headers, it is common to use metallic joist hangers. Such a hanger includes a U-shaped body comprised of a pair of side legs and a bottom web interconnecting the lower ends of the legs. Each leg of the hanger has a pair of mutually perpendicular parts, one part adapted to be nailed or otherwise affixed to the header and the other part adapted to be nailed or otherwise affixed to the side of the joist to be hung.

Generally, the hangers for a number of joists are mounted one by one after numerous measurements have been made on the header to provide alignment marks for the hangers. This procedure is time consuming and quite tedious where a large number of joist hangers are to be put into place. This represents a high labor cost, and such cost is to be reduced if at all possible. A need, therefore, has existed for some time for a tool which can be used to mount joist hangers in a minimum of time and with a minimum expenditure of effort. The present invention satisfies this need.

SUMMARY OF THE INVENTION

The present invention is directed to a tool having a first, beam-like member adapted to rest on the upper face of a header to which a joist hanger is to be mounted. A magnetic structure is coupled with the first member for holding a joist hanger in place by magnetic attraction as the first member is supported on the upper margin of the header. Thus, the hanger can be nailed or otherwise fastened to the front face of the header, whereupon the first member and the magnetic structure can be removed from the header and placed at a second location for mounting a joist hanger.

A preferred embodiment of the magnetic structure includes a second, beam-like member which is coupled with the first member and has a pair of opposed flat side faces provided with magnetic structure thereon. Such magnetic structure can be in the form of spaced, permanent magnets extending into holes drilled in the side faces of the second member. The magnetic structure can be in the form of magnetic tape or magnetic coating of some type or other permanent magnets. The second member has a bottom face which is to engage the upper surface of the web of a hanger while the side legs of the hanger are magnetically attracted to the magnet structure carried by the second member.

The second member can be removably and adjustably coupled to the first member by alignment structure, whereby the first and second members can be placed side by side so that the tool can be collapsed and the members can be stored in a compact position. The alignment structure includes a pair of spaced pins projecting outwardly from the front face of the first member, the pins being received within an elongated slot extending through the second member, there being a threaded shaft extending through the slot of the second member for receiving a wing nut which, when tightened, clamps the two members together. The width of the second member can be chosen so as to accommodate joist hangers of different dimensions, such as joist hangers for joists having dimensions of 2×4, 2×6, 4×4, 4×6, 6×6, 6×8 and others.

The primary object of the present invention is to provide a tool for use in mounting joist hangers on a header wherein the hangers are magnetically attracted to the tool and the tool positions the hangers on the header so that the hangers can be fastened by nails or other fasteners to the exposed front face of the header.

Other objects of this invention will become apparent as the following specification progresses, reference being had to the accompanied drawings for an illustration of the present invention.

BRIEF DESCRIPTION OF THE DRAWINGS

FIGS. 3 and 4 are perspective views of the two main members of the tool with the members being separated from each other;

FIG. 5 is a fragmentary, perspective view of a joist attached to a header by a joist hanger of the type shown in FIG. 2; and FIG. 6 is a fragmentary cross-sectional view of the tool, showing one of the magnets thereof.

DETAILED DESCRIPTION OF THE DRAWINGS

Figure 2:
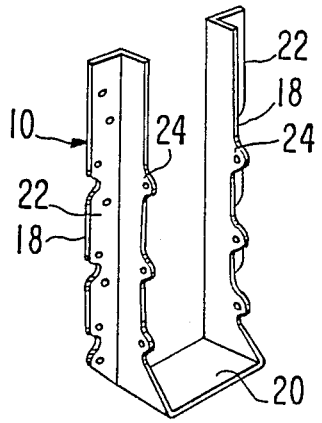
FIG. 2 is perspective view of a joist hanger usable with the tool of the present invention.

The tool of the present invention is broadly denoted by the numeral 10. Tool 10 is adapted to be used with a metallic joist hanger 16 shown in FIG. 2, the hanger 16 including two upright legs 18 and a bottom web 20 interconnecting the lower extremities of legs 18. Each leg 18 has a first part 22 integral with a second part 24 with parts 22 and 24 being mutually perpendicular to each other. Holes are formed in parts 22 and 24 to receive nails or other fasteners for attaching the joist hanger 16 to a header 37 and to a joist 39, respectively (FIG. 5) after the tool 10 has been put into use. The hanger 16 is magnetically attracted to magnetic structure.

Tool 10 is comprised of two beam-like members 12 and 14 which are normally attached together when the tool is in use but which can be separated from each other to permit storage of the tool in a compact space. Members 12 and 14 can be of any suitable material, but preferably they are of wood.

Member 12 has a flat front face 26 provided with a pair of spaced pins 28 and 30 projecting laterally from the midpoint of face 26. Member 12 further has a threaded shaft 32 between pins 28 and 30 and generally parallel with the pins.

Figure 1:
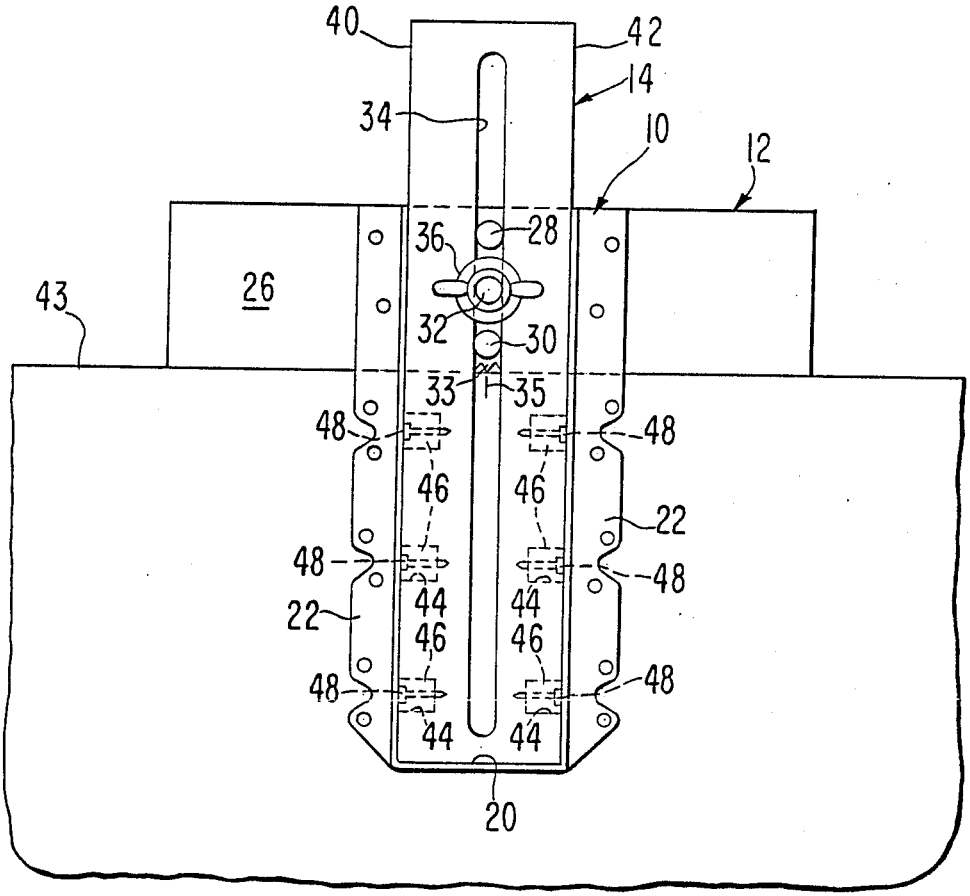
FIG. 1 is a perspective view of the tool of the present invention, showing the way in which a joist hanger is mounted on the tool for attachment to a side face of a header.

Member 14 has an elongated, centrally disposed slot 34 therethrough for adjustably receiving pins 28 and 30 and shaft 32. The pins project only a short distance into the slot 34 and the pins are used to orient the members 12 and 14 with respect to each other such that member 14 and member 12 are perpendicular to each other when the tool 10 is to be used. A wing nut 36 is threadably mounted on shaft 32 for rigidly securing members 12 and 14 together when pins 28 and 30 are in slot 34 as shown in FIG. 1. When members 12 and 14 are so arranged, the tool 10 is now ready for use in the manner hereinafter described.

Member 12 has a pointed edge 33 at the lower margin thereof, edge 33 being aligned vertically with pins 28 and 30 and shaft 32. Edge 33 is to be used for aligning the tool with respect to a marker 35 on the front face 37 of a header 37 (FIG. 5) in the manner hereinafter described.

Member 14 has a pair of flat side faces 40 and 42 provided with spaced bores 44 therein (FIG. 6). Bores 44 are provided with a magnetic means, such as permanent magnets 46 which are held in place by pins 48 driven into member 14 as shown in FIG. 6. For purposes of illustration, there are three magnets 46 on each side face 40 or 42 of member 14, respectively. The magnets of each side face are vertically spaced apart uniformly and are horizontally aligned with the respectively magnets on the other side face as shown in FIG. 1. The outer end of each magnet 46 is near or substantially adjacent to the respective side face of the second member 14.

While magnets shown in FIGS. 1 and 6 are the preferred embodiments of the magnetic structure on member 14, other magnetic means can be used if desired. For instance, magnetic tape could be applied to localized areas of member 14 or as a strip along the side faces 40 and 42. It is only necessary for the magnetic means to attract and hold legs 18 of a joist hanger 16 (FIG. 2) on the member 14 when the joist hanger is to be attached to the front face 41 of header 28.

In use, members 12 and 14 are adjustably coupled together by wing nut 36 as shown in FIG. 1. A joist hanger 16 is then applied to the magnets 46 on the opposed side faces 40 and 42 of member 14. Specifically, the magnets will attract parts 24 of legs 18 of hanger 16 with the web 20 of hanger 16 being in engagement with the flat bottom face of member 14. The height of member 14 along member 12 can be adjusted such that the upper ends of legs 18 of hanger 16 are near the upper face 43 of header 28 as shown in FIG. 5.

With the joist hanger 16 coupled to the magnets of member 14 and with member 12 resting on the top face 43 of header 37, nails can be driven into the holes of parts 22 and into the header to attach the hanger to the header. This attachment step is accomplished after the alignment edge 33 (FIG. 1) of member 12 is aligned with a marker 35 placed by a pencil or other marking device by the workman using tool 10.

After joist hanger 16 is attached to header 37, the tool can be lifted away from the header and the attached hanger 16, and the tool can be moved to the next location at which a hanger is to be placed on the header.

The tool 10 can accommodate joist hangers 16 for joists 39 of different dimensions. The joist can, for instance, be a 2×4, 2×6, 2×8, 4×4, 4×6, 4×8, 6×6, 6×8 or other dimensions. For a 2×2 joist, the member 14 is made in a width (2×2) such as to accommodate a 2×2 hanger 16. Similarly, member 14 will be a 2×4 for a 2×4 hanger, and so on.

When it is desired to store the tool 10, wing nut 36 is loosened to allow member 14 to extend longitudinally of member 12. This is accomplished by rotating the member 14 relative to member 12 through an angle of approximately 90°. Holes (not shown) in the back face of member 14 are adapted to receive pins 28 and 30 so that members 12 and 14 will fit snugly and against each other for storage in a minimum of space.

I claim:

1. A tool for mounting a metallic joist hanger to a header comprising:

a first member having a lower surface adapted to rest in an operative position on the upper face of a header to the side face of which a hanger is to be secured; and a second member coupled with the first member and extending downwardly therefrom, said second member adapted to be located adjacent to a side face of the header when the beam member is in said operative position, said second member having magnetic structure thereon for magnetically coupling a joist hanger thereto to allow the joist hanger to be positioned adjacent to the side face of the header when the second member is adjacent to said side face, whereby fasteners can be used to secure the joist hanger in place on the side face of the header as the first member remains in said operative position.

2. A tool as set forth in claim 1, wherein said second member has a pair of opposed side faces, said magnetic structure being on at least one of the side faces thereof.

3. A tool as set forth in claim 2, wherein said magnetic structure includes a number of permanent magnets at spaced locations on the side faces of said second member.

4. A tool as set forth in claim 3, wherein each magnet has a center bore therethrough, and a pin through the bore and into the second member for mounting the magnet on the second member.

5. A tool as set forth in claim 1, wherein said second member has a slot therethrough extending longitudinally thereof, said first member having an alignment means extending into the slot to position said magnetic structure on the second member below the first member.

6. A tool as set forth in claim 5, wherein said alignment means includes a pair of spaced pins projecting laterally from the first member.

7. A tool as set forth in claim 6, wherein the width of the pins is substantially equal to the width of the slot.

8. A tool as set forth in claim 7, wherein is included a threaded shaft extendable through the slot, and a nut threadably mounted on the shaft for attaching the members together.

9. A tool for mounting a magnetizable joist hanger on a header with the hanger having a pair of side legs and a bottom web connected to the lower ends of the legs comprising:

a first member having a lower flat face for resting on the upper flat face of a header to which a hanger is to be attached;

a second member;

means for releasably coupling the members together with the second member being generally perpendicular to the first member, said second member having a pair of opposed flat side faces and a flat bottom face; and magnetic means on the side faces of the second member for attracting magnetically the legs of the joist hanger to be attached to the header when the bottom face of the second member engages the web of the hanger said second member being adjustable in vertical position relative to the first member.

10. A tool as ser forth in claim 9, wherein said magnetic means includes a number of permanent magnets for each side face of the second member, respectively.

11. A tool as set forth in claim 9, wherein said magnet means includes magnetic tape attached to each side face, respectively, of the second member.

12. A tool for mounting a metallic joist hanger to a header with the hanger having a pair of legs and a bottom web interconnecting the legs, said tool comprising:

a first member having a lower surface adapted to rest in an operative position on the upper face of a header to which a hanger is to be secured; and a second member coupled with the first member, said second member having a pair of opposed side faces adapted to be placed adjacent to the legs of the hanger and a bottom face adapted to be placed adjacent to the web of the hanger, there being magnetic structure on at least one of the side faces of the second member for positioning the hanger adjacent to the header when the first member is in said operative position, whereby fasteners can be provided to secure the hanger in place on the header as the first member remains in said operative position.

13. A tool for mounting a metallic joist hanger to a header comprising:

a first member having a lower surface adapted to rest in an operative position on the upper face of a header to which a hanger is to be secured; and a second member coupled with the first member and having a pair of opposed side faces, there being a number of permanent magnets at spaced locations on the side faces of the second member, said magnets adapted to be magnetically coupled to the sides of a joist hanger for positioning the joist hanger adjacent to the header when the first member is in said operative position, whereby fasteners can be provided to secure the joist hanger in place on the header as the first member remains in said operative position, each magnet having a center bore therethrough, and a pin extending through the bore and into the second member, each magnet being loosely mounted on the respective pin.

14. A tool for mounting a metallic joist hanger to a header comprising:

a first member having a lower surface adapted to rest in an operative position on the upper face of a header to which a hanger is to be secured; and magnetic means coupled with the first member and adapted to be magnetically coupled to the side of a joist hanger for positioning the joist hanger adjacent to the header when the first member is in said operative position, whereby fasteners can be provided to secure the joist hanger in place on the header as the first member remains in said operative position, said magnetic means including a second member having a slot therethrough extending longitudinally thereof, said first member having a pair of spaced pins projecting laterally from the first member and extending into the slot to position a magnetic structure on the second member below the first member, the width of the pins being substantially equal to the width of the slot, and including a threaded shaft extendable through the slot, and a nut threadably mounted on the shaft for attaching the members together, said first member having an index edge at the lower margin thereof, said edge being viewable through the slot.

* * * * *